US005344177A

United States Patent [19]

Rouser et al.

[11] Patent Number: 5,344,177

[45] Date of Patent: Sep. 6, 1994

[54] SKI BASE AND RUNNING SURFACE

[75] Inventors: Forrest J. Rouser, San Rafael, Calif.; John D. Chang, Afton; Mark E. Reeves, Maplewood, both of Minn.

[73] Assignee: Minnesota Mining and Manufacturing Company, St. Paul, Minn.

[21] Appl. No.: 9,312

[22] Filed: Jan. 22, 1993

Related U.S. Application Data

[63] Continuation-in-part of Ser. No. 875,186, Apr. 28, 1992, Pat. No. 5,201,101.

[51] Int. Cl.[5] ..... A63C 5/04; A63C 7/04

[52] U.S. Cl. ..... 280/610; 280/604; 24/575

[58] Field of Search ..... 280/610, 604; 24/575, 24/576, 578, 587

[56] References Cited

U.S. PATENT DOCUMENTS

| | | | |
|---|---|---|---|
| 3,635,484 | 1/1972 | Nakamura et al. | 280/11.13 |
| 3,894,745 | 7/1975 | Heim et al. | 280/610 |
| 3,967,992 | 7/1976 | McCaskey, Jr. et al. | 156/85 |
| 3,980,312 | 9/1976 | Buttner | 280/610 |
| 4,077,652 | 3/1978 | McCaskey, Jr. et al. | 280/610 |
| 4,093,268 | 6/1978 | Sampson et al. | 280/610 |
| 4,118,051 | 10/1978 | Shima | 280/610 |
| 4,148,500 | 4/1979 | Nidecker | 280/604 |
| 4,178,012 | 12/1979 | Roth et al. | 280/609 |
| 4,223,909 | 9/1980 | Danner et al. | 280/604 |
| 4,272,577 | 6/1981 | Lyng | 428/112 |
| 4,343,863 | 8/1982 | Lawrence et al. | 428/485 |
| 4,398,746 | 8/1983 | Heintz | 280/604 |
| 4,440,418 | 4/1984 | Staufer | 280/604 |
| 4,530,871 | 7/1985 | You | 428/111 |
| 4,564,210 | 1/1986 | Case | 280/604 |
| 4,875,259 | 10/1989 | Appeldorn | 24/576 |
| 5,002,301 | 3/1991 | Cagneux et al. | 280/610 X |
| 5,113,555 | 5/1992 | Wilson et al. | 24/576 |
| 5,160,158 | 11/1992 | Scherübl | 280/610 |
| 5,201,101 | 4/1993 | Rouser et al. | 24/576 |

FOREIGN PATENT DOCUMENTS

| | | | |
|---|---|---|---|
| 0917688 | 12/1972 | Canada | 280/610 |
| 2402791 | 7/1975 | Fed. Rep. of Germany . | |
| 3414440A1 | 10/1985 | Fed. Rep. of Germany | 280/610 |
| 0276238 | 2/1990 | Fed. Rep. of Germany | 280/610 |
| 2613242 | 10/1988 | France . | |

*Primary Examiner*—Margaret A. Focarino
*Assistant Examiner*—Peter English
*Attorney, Agent, or Firm*—Gary L. Griswold; Walter N. Kirn; Jeffrey J. Hohenshell

[57] ABSTRACT

A ski base sheet and ski body are disclosed. The ski base sheet is removable from the ski body and reusable. The ski base sheet is attached to the ski body by using a structured surface. A number of different ski base sheets may be used interchangably on the ski body.

14 Claims, 3 Drawing Sheets

SKI BASE AND RUNNING SURFACE

This application is a continuation-in-part of U.S. patent application Ser. No. 07/875,186 filed Apr. 28, 1992, now U.S. Pat. No. 5,201,101.

SUMMARY

The present invention relates to skis, and more particularly to an improved ski body and ski base.

BACKGROUND OF THE INVENTION

Skiing is a popular sport enjoyed by many persons worldwide. It is estimated that there are 15.5 million alpine skiers and about 7.2 million nordic or "cross country" skiers in the United States alone. Skis are also used in other endeavors such as snowmobiling, water skiing and snowboarding.

In some instances, it may be desirable to change the running surface (and hence the frictional characteristics) of a particular ski. For example, in cross-country skiing, a skier may desire a different running surface with a different frictional characteristic depending upon whether the snow is icy or powdery or upon the particular terrain to be traversed (e.g. flat or inclined).

The art is replete with advances relating to skis such as those described in U.S. Pat. No. 3,635,484 to Nakamura et al.; U.S. Pat. No. 3,967,992 to McCaskey Jr., et al.; U.S. Pat. No. 4,077,652 to McCaskey Jr., et al.; U.S. Pat. No. 4,093,268 to Sampson et al.; U.S. Pat. No. 4,178,012 to Roth et al.; U.S. Pat. No. 4,223,909 to Danner et al.; U.S. Pat. No. 4,272,577 to Lyng; U.S. Pat. No. 4,343,863 to Lawrence et al.; U.S. Pat. No. 4,398,746 to Heintz; U.S. Pat. No. 4,440,418 to Stauffer; U.S. Pat. No. 4,530,871 to You and U.S. Pat. No. 5,160,158 to Scherubl.

German Offenlegungsschrift No. 2,402,791 to Hasse describes a cover film which may be detachably attached to the base surface of the ski by means of, for example, an adhesive. In some instances, when the running surface is removed, the adhesive is exposed to contamination from dust and dirt and may undesirably adhere to structures such as clothes and containers. Skis for use in water are particularly susceptible to contamination from sand, salt and floating debris. Other means are disclosed to attach one element of the ski to another element. However, it is believed that such means may be difficult to manually perform, particularly when the task is performed in cold conditions which may adversely affect a skier's manual dexterity.

DISCLOSURE OF THE INVENTION

The present invention is directed to a ski body and a removable, repositionable and reusable ski base sheet. The ski base sheet may be easily and conveniently attached to the ski body without the need for an adhesive at the juncture between the ski base sheet (the element of the ski which has a running surface) and the rest of the ski.

According to the present invention, there is provided an elongate ski body comprising opposite top and attachment surfaces, front and rear ends and a pair of edges. The attachment surface of the ski body comprises a structured surface extending transversely across at least portions of the ski body for releasably and repeatably attaching the ski body to the reusable ski base sheet.

The reusable ski base sheet comprises opposite running and attachment surfaces. Like the ski body, the attachment surface of the ski base sheet comprises a structured surface for releasably and repeatably attaching the ski base sheet to the ski body.

BRIEF DESCRIPTION OF THE DRAWINGS

The present invention will be further described with reference to the accompanying drawings wherein like reference numerals refer to like parts in the several views, and wherein.

DETAILED DESCRIPTION

Figure 1:
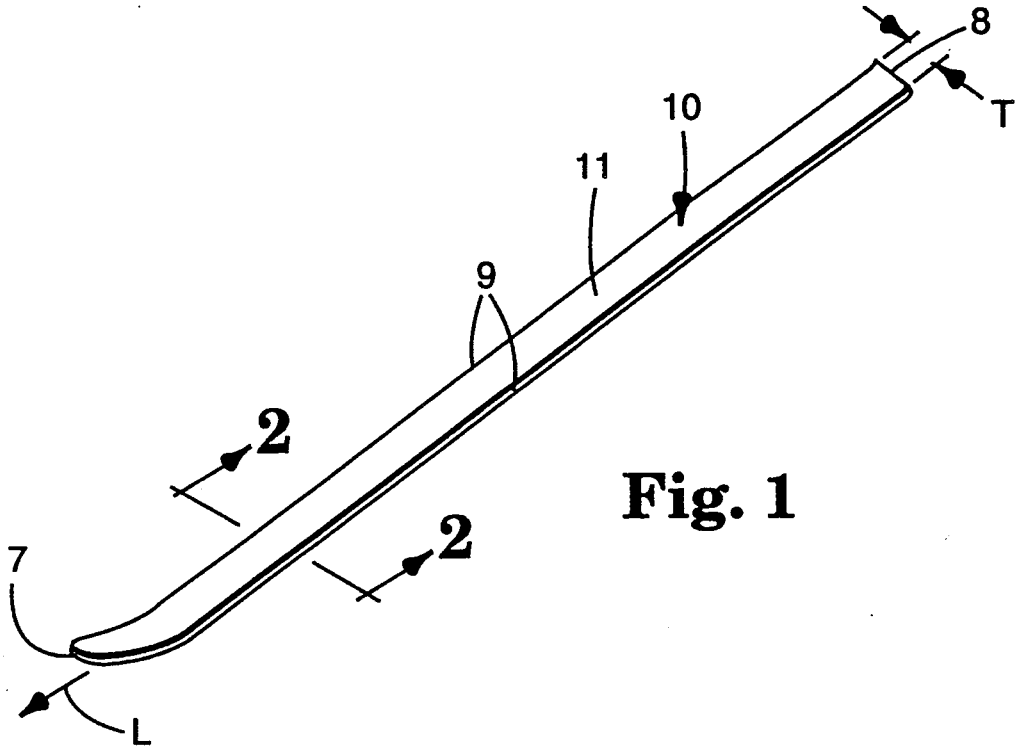
FIG. 1 is a perspective view of a ski according to the present invention.
Figure 2:
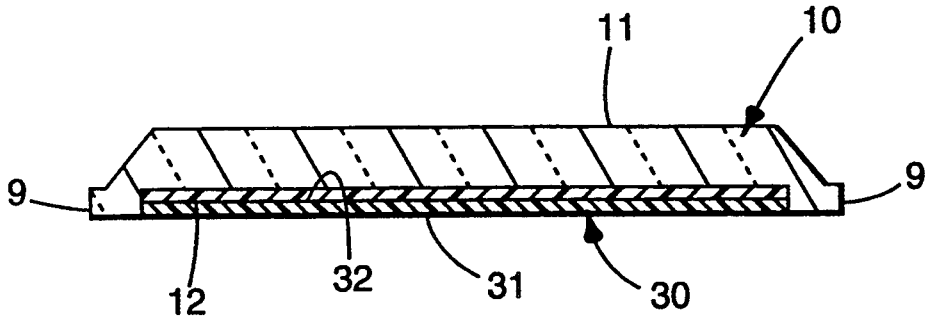
FIG. 2 is an enlarged cross section of the ski of FIG. 1 taken approximately along lines 2—2 of FIG. 1.

Referring now to FIGS. 1 through 4 of the drawing, there is shown embodiments of a ski according to the present invention.

Figure 4:
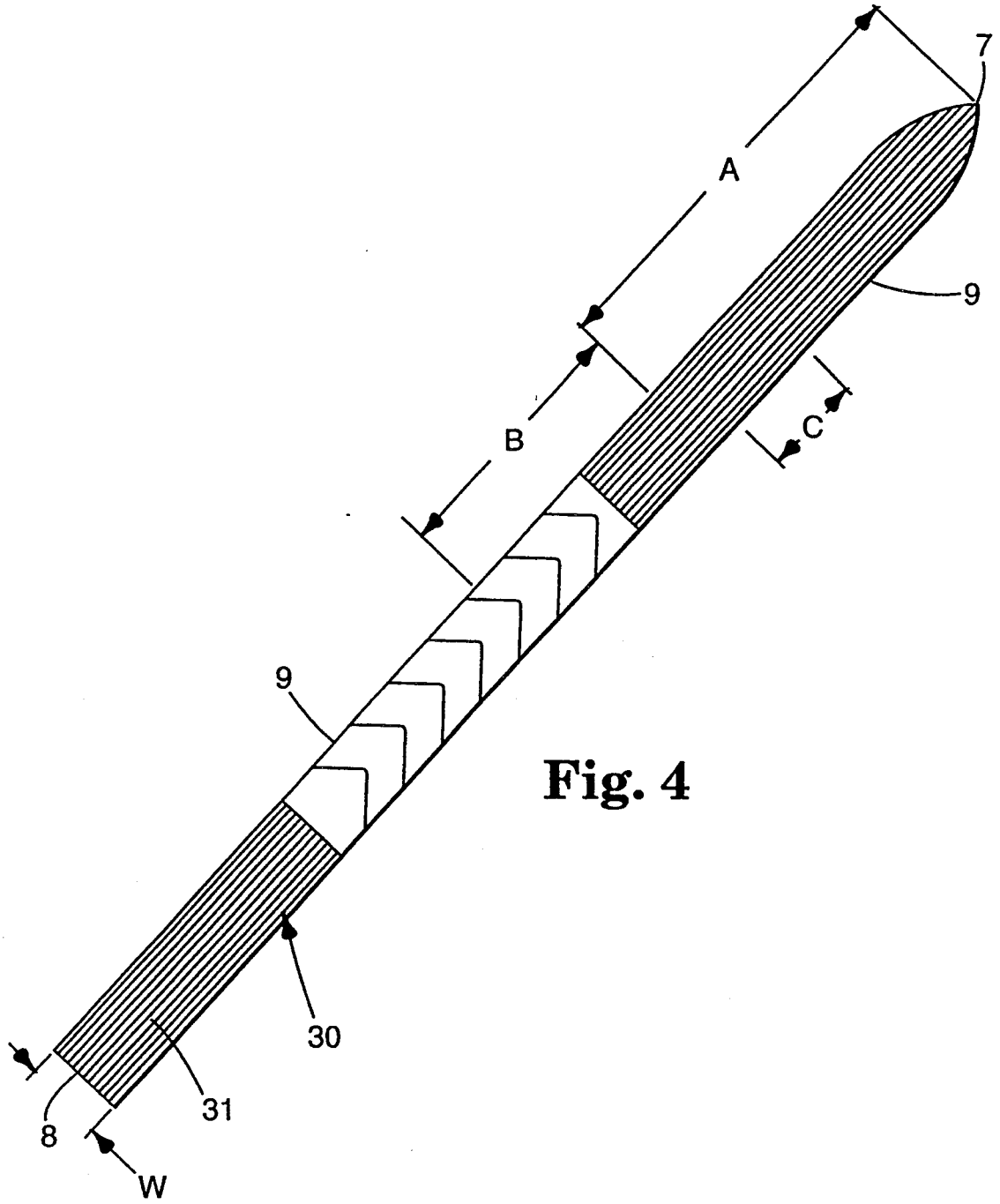
FIG. 4 is a bottom view of a ski according to the present invention.

The ski comprises a ski body 10 and a reusable ski base sheet 30. The ski body 10 is elongate and defines a longitudinal axis L and a transverse direction T which is generally perpendicular to the longitudinal axis L and which defines a width W (FIG. 4). The ski body 10 has generally opposite top 11 and attachment 12 surfaces, edges 9 and front 7 and rear 8 ends (see FIG. 2).

The ski base sheet 30 has generally opposite running 31 and attachment 32 surfaces. The running surface 31 may comprise any suitable running surface known in the art, and may include a series of longitudinal grooves (FIG. 3) or a non-uniform pattern (FIG. 4). Alternatively, the running surface may include a series of grooves situated at an angle relative to the longitudinal axis. The desired running surface pattern will depend upon the particular use for the ski such as ski jumping, cross-country skiing, downhill skiing, and according to conditions (e.g. ice or snow or the incline of the terrain to be traversed).

The ski base sheet 30 is elongate to define a longitudinal axis (e.g. generally parallel to the axis L), a length along its longitudinal axis and a width (e.g. generally along the direction T shown in FIG. 1). The ski body 10 may be used with different ski base sheets having different running surfaces. For example, during a cross-country ski outing, a skier may desire to change the frictional characteristics of the running surface of the ski due to anticipated hilly terrain. To accomplish this end, a user would simply remove the ski base sheet 30 and replace it with another ski base sheet having a running surface with different frictional characteristics.

Figure 3:
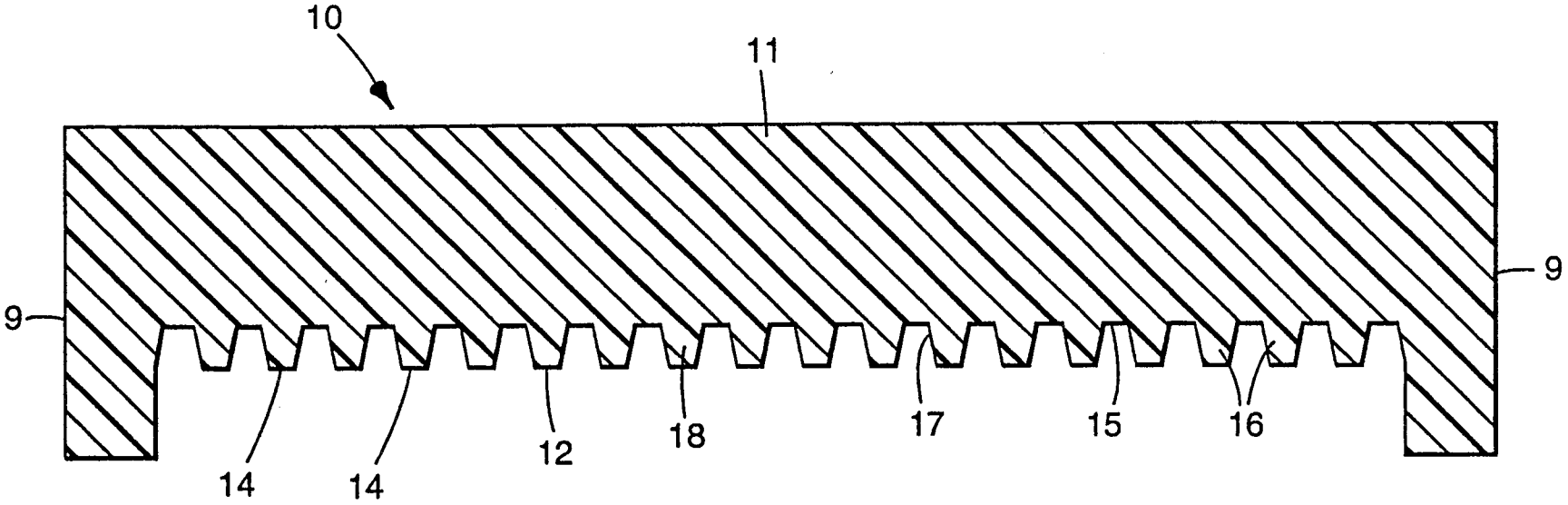
FIG. 3 is a schematic cross section of a ski similar to FIG. 2 which illustrates structured surfaces on a ski body and ski base sheet.
Figure 3:
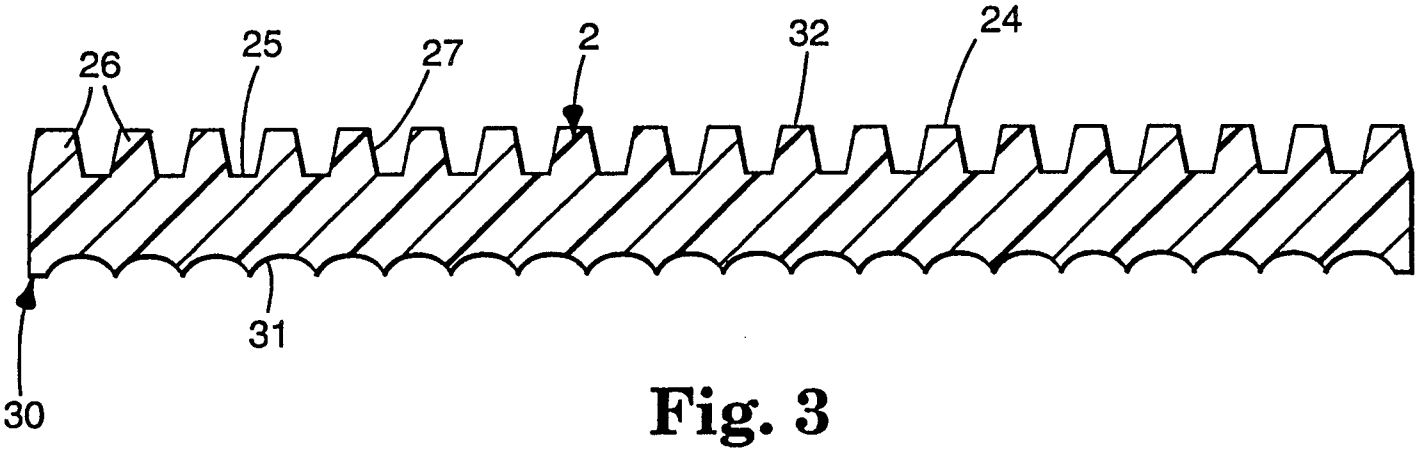

Referring now to FIG. 3 there is shown an example of the attachment surfaces 12; 32 which comprise structured surfaces 14; 24 extending transversely across at least portions of the ski body 10 and base 30 for releasably and repeatably attaching the ski body 10 to the reusable ski base sheet 30.

As used herein, the phrase "structured surface" is used broadly and means any surface for attaching to another surface at least partially due to friction between the structured surface and the other surface, as opposed, for example, to a fastener which fastens two articles together by means of interlocking between elements.

The bottom or attachment surface side of the ski body 10 preferably has portions adjacent each edge 9 of the ski and a middle portion (e.g. reference character 18) which extend along at least a portion of the length of the ski. The structured surface 14 of the ski body 10 preferably extends transversely across at least portions of the ski body. When it is said that the structured surface 14 "extends transversely across at least portions of the ski body" it is meant that there are portions of the structured surface 14 located in the middle portion 18 and generally adjacent each edge 9 of the ski allowing for a rail (e.g. such as a metal rail common for most modern downhill skis) or other structure to form the actual edge of the ski.

The top or attachment surface side of the ski base sheet 30 preferably has portions adjacent each of its edges and a middle portion (e.g. reference character 2) which extend along at least a portion of the length of the ski base sheet. The structured surface 24 of the ski base sheet 30 preferably extends transversely across at least portions of the ski base sheet. When it is said that the structured surface 24 "extends transversely across at least portions of the ski base sheet" it is meant that there are portions of the structured surface 24 located in the middle portion 2 and generally adjacent each edge of the ski base sheet.

The attachment surfaces 12; 32 of both the ski body 10 and the ski base sheet 30 preferably comprise the fasteners described in U.S. Pat. No. 4,875,259 to Appeldorn or U.S. patent application Ser. No. 07/875,186 filed Apr. 28, 1992, now U.S. Pat. No. 5,201,101. The entire contents of each of those patents as well as each patent mentioned in those patents is herein expressly incorporated by reference.

Each of the attachment surfaces 12 and 32 preferably comprise a structured surface 14; 24 comprising a common plane or surface 15; 25, and a plurality of tapered elements 16; 26. Each element 16; 26 has at least one side 17; 27 inclined relative to the common plane 15; 25 at an angle sufficient to form a taper. For example, if the tapered elements are those as generally described in U.S. Pat. No. 4,875,259 to Appeldorn, the structured surface of the ski body 10 frictionally adheres to a structured surface of the reusable ski base sheet 30.

The tapered elements 16; 26 project in a direction generally perpendicular to the longitudinal axis L and the transverse direction T. As described in U.S. Pat. No. 4,875,259 to Appeldorn or U.S. patent application Ser. No. 07/875,186 filed Apr. 28, 1992, now U.S. Pat. No. 5,201,101, the tapered elements 16; 26 have a geometry including a height and cross-sectional shape.

The ski base sheet 30 may be constructed from any suitable material such as a plastic, polymer or possibly even a metal, so long as the ski base sheet is sufficiently taut to withstand normal operating conditions. Preferably, the ski base sheet 30 is flexible so that it may be rolled for convenient storage during use. As an example not intended to be limiting, the ski base is preferably less than about 0.5 inch thick and preferably less than about 0.25 inches thick. However, different thicknesses are contemplated according to the running surface geometry and particular material used to construct the ski base sheet.

The ski base sheet 30 is attached to the ski body 10 without the necessity for an adhesive at the juncture between the ski base sheet 30 (e.g. the element having the running surface) and the rest of the ski (e.g. the ski body 10). The lack of adhesive on the outer surfaces of ski base sheet 30 affords convenient storage of the ski base sheet 30 as there is no adhesive layer that may accumulate dust, dirt or other ambient particles and which may undesirably adhere to articles such as clothing or containers.

Additionally, the structured surfaces afford ease of attachment and release of the base 30 to the body 10. For example, if one of the structured surfaces as described in U.S. patent application Ser. No. 07/875,186 filed Apr. 28, 1992, now U.S. Pat. No. 5,201,101 is used, the ski base 30 may be repositioned relative to ski body 10 due to the universal nature of the structured surfaces described in that patent (see Example 1 of that patent). Such a fastener affords a convenient, easy attachment and release of the base 30 from the body 10. The ease and convenience of attachment and release of the base and body are believed to be particularly important when those operations are performed outside in a cold environment which may adversely affect a skier's manual dexterity.

As shown in FIG. 3, the top surface 11 and attachment surface 12 of the ski body 10 may comprise an integral, monolithic, uniform composition. Also, the running surface 31 and attachment surface 32 of the ski base sheet 30 may comprise an integral, monolithic, uniform composition. However, both the ski body 12 and base 30 may be constructed from a plurality of elements that are attached together (see Example 1 below).

The structured surfaces 14 and 24 may optionally be utilized to alter the flexure or "flexibility" of the ski along its length. For example, the geometry of the tapered elements along the length L of the ski body 10 may be changed (e.g. it is not uniform) to change the flexure characteristics of the ski body. Referring to FIG. 4 as an example, the tapered elements along the length A may have a greater height than the tapered elements along length B (e.g. 25 mil vs. 4 mil) or may have a different cross sectional shape (e.g. triangular or elliptical) or may have a different spacing. It is believed that the effect on the flexibility of the ski body will be particularly pronounced when the ski base sheet is attached to the ski body.

The flexure characteristics of the ski may also be controlled by extending the structured surface only along a portion of the length of the ski body 10 or ski base sheet 30. For example, again referring to FIG. 4, the surface of the ski base 30 (and/or the ski body 10) directly opposite the running surface along the length of the ski identified as reference character "C" (FIG. 4) may be free of the structured surface.

Alternatively, for example, the back portion of the ski may be completely free of an attachment surface and instead may comprise a non-removable running surface. In this example, only portions of the bottom surface of the ski may include the attachment surface 12. Affording control of the strength of the bonding of the ski base to the ski body and the flexibility of the ski allows the ski to be tailored to a particular user or snow condition.

EXAMPLE

A prototype ski body model was constructed as follows: A Gremlin model ski was obtained from Hart Skis of St Paul, Minn. The ski was modified by removing approximately 0.065 inches of material from the bottom of the ski leaving the metal edges to form a "first portion" of the ski body. A structured surface constructed from a polyvinylchloride (PVC) material and having the dimensions set forth in Example 1 of U.S. patent application Ser. No. 07/875,186 filed Apr. 28, 1992, now U.S. Pat. No. 5,201,101 (e.g. the second portion of the ski body) was adhesively adhered to the bottom surface of the ski using Scotch TM brand adhesive generally available from the Minnesota Mining and Manufacturing Co. (3M) of St. Paul, Minn. identified as Part No. 03958, 3M identification No. 70-0060-0852-1 and generally available from Chartiers Supply Corporation of Washington, Pa. However, any suitable adhesive compatible with the two materials may be used. The ski base sheet was constructed as follows: A structured surface constructed from a polyvinylchloride material and having the dimensions set forth in Example 1 of U.S. patent application Ser. No. 07/875,186 filed Apr. 28, 1992, now U.S. Pat. No. 5,201,101 (e.g. the second portion of the ski base sheet) was adhered to a first side of the first portion of the ski base sheet using the same adhesive mentioned above.

Figure 5:
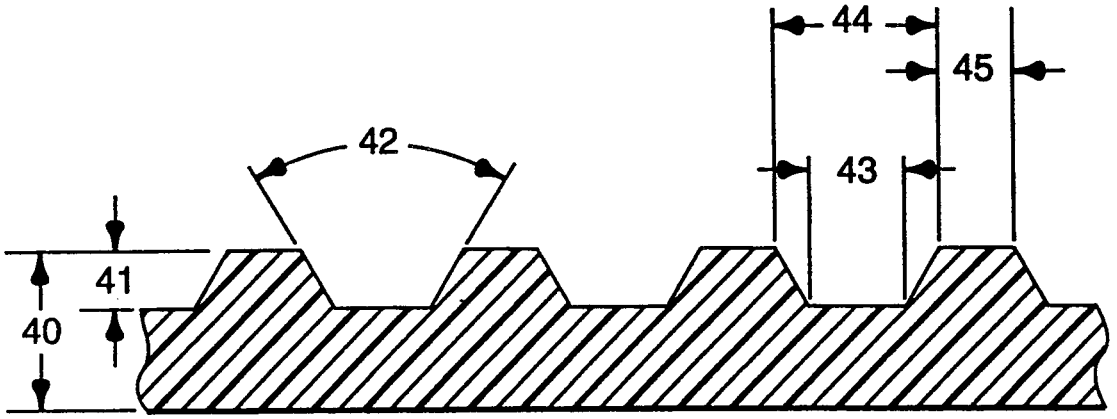
FIG. 5 is a sectional view of a tool which may be used to construct a running surface for the ski according to the present invention.

The first portion of the ski base sheet comprised a Teflon (Polytetrafluoroethylene) polymer material Number 202 generally available from DeWal Industries, Inc. of Saunderstown, R.I. The material was six (6) inches wide by 0.02 inches thick by forty-eight (48) inches long. Approximately the middle four inches of the second side of the Teflon (Polytetrafluoroethylene) material included a patterned running surface constructed using the tool of FIG. 5. The tool created a running surface having approximately the following dimensions: 40:0.02 inches; 41:0.004 inches; 42:45 degrees; 43:0.0077 inches; 44:0.011 inches; 45:0.004 inches. The ski base sheet was then cut to fit the ski.

The running surface was constructed by compression molding on Pasadena Hydraulic Inc. 300 Ton Press which utilized steam heated and water cooled steel platens. The teflon was heated from 75 degrees fahrenheit to 375 degrees fahrenheit with 45 pounds per square inch of pressure for nine minutes; then at 375 degrees fahrenheit with 2,083 pounds per square inch of pressure for 9 minutes; and then cooled for 7 minutes under 2,083 pounds per square inch of pressure until the temperature was 150 degrees.

The present invention has now been described with reference to several embodiments thereof. It will be apparent to those skilled in the art that many changes or additions can be made in the embodiments described without departing from the scope of the present invention. For example, the front portion of the ski base sheet may be tucked into a groove on the bottom of the ski body. Also, an enhancement to the attachment of the ski base sheet to the ski body may be provided generally at the corners of the ski base sheet. Thus, the scope of the present invention should not be limited to the structures described in this application, but only by structures described by the language of the claims and the equivalents of those structures.

What is claimed is:

1. An elongate body for a ski which defines a longitudinal axis and a transverse direction generally perpendicular to the longitudinal axis, the body for the ski comprising:

generally opposite top and attachment surfaces, said body attachment surface comprising a structured surface extending transversely across at least portions of the ski body for releasably and repeatably attaching the ski body to a reusable ski base sheet having generally opposite running and attachment surfaces, the structured surface comprising a common plane or surface, and a plurality of tapered elements, each element having at least one side inclined relative to the common plane at an angle sufficient to form a taper, wherein the structured surface of the ski body is adapted to frictionally adhere to a structured surface of the attachment surface of the reusable ski base sheet, wherein the tapered elements have a geometry including a height and cross-sectional shape, the ski body has a length along the longitudinal axis, and the geometry of the tapered elements along the length of the ski body is not uniform to alter the flexure characteristics of the ski body along its length when the ski base sheet is attached to the ski body.

2. A body for a ski according to claim 1 wherein the tapered elements project in a direction generally perpendicular to both the longitudinal axis and transverse direction.

3. A body for a ski according to claim 1 wherein the ski body may be used with different ski base sheets having different running surfaces.

4. A body for a ski according to claim 1 wherein the ski body has a length along the longitudinal axis of the ski body and the structured surface extends only along a portion of the length of the ski body.

5. A body for a ski according to claim 1 wherein the top surface and attachment surface of the ski body comprise an integral, monolithic uniform composition.

6. A body for a ski according to claim 1 wherein the ski body comprises a first portion which includes the top surface, and a second portion which includes the ski body attachment surface, and the second portion is attached to the first portion.

7. A ski base sheet comprising:

opposite running and attachment surfaces, the attachment surface comprising a structured surface for releasably and repeatably attaching the ski base sheet to a ski body so that the ski base sheet may be reused, wherein the structured surface comprises a common plane or surface, and a plurality of tapered elements, each element having at least one side inclined relative to the common plane at an angle sufficient to form a taper, wherein the structured surface of the ski base sheet is adapted to frictionally adhere to a structured surface of the ski body, wherein the tapered elements of the ski base sheet have a geometry including a height and cross-sectional shape, the ski base sheet has a length along a longitudinal axis, and the geometry of the tapered elements along the length of the ski base sheet is not uniform to change the flexure characteristics of the ski body and ski base sheet assembly along their length when the ski base sheet is attached to the ski body.

8. A ski base sheet according to claim 7 wherein the ski base sheet is elongate to define said longitudinal axis, said length, a transverse direction and a width.

9. A ski base sheet according to claim 7 wherein the structured surface extends transversely across at least portions of the ski base sheet.

10. A ski base sheet according to claim 7 wherein the ski base sheet has a transverse direction which is substantially perpendicular to the longitudinal axis, and the tapered elements of the ski base sheet project in a direction generally perpendicular to both the transverse direction and the longitudinal axis.

11. A ski base sheet according to claim 7 wherein the ski base sheet has a width, and the structured surface extends entirely across the width of the ski base sheet.

12. A ski base sheet according to claim 7 wherein the structured surface extends only along a portion of the length of the ski base sheet.

13. A ski base sheet according to claim 7 wherein the ski base sheet comprises an integral, monolithic, uniform composition.

14. A ski base sheet according to claim 7 wherein the ski base sheet comprises a first portion which includes the running surface, and a second portion which includes the attachment surface, and the second portion is attached to the first portion.

* * * * *